US005658503A

United States Patent [19]

Johnston et al.

[11] Patent Number: 5,658,503

[45] Date of Patent: Aug. 19, 1997

[54] DUAL PHASE DISTRIBUTION DEVICE

[75] Inventors: Stephen W. Johnston, Sugar Land, Tex.; Philip C. Lewellen, Hopkinton, Mass.

[73] Assignee: Shell Oil Company, Houston, Tex.

[21] Appl. No.: 595,159

[22] Filed: Feb. 1, 1996

[51] Int. Cl.[6] ..... B01F 3/04

[52] U.S. Cl. ..... 261/78.2; 261/146; 261/153

[58] Field of Search ..... 261/78.2, 146, 261/153

[56] References Cited

U.S. PATENT DOCUMENTS

| | | | |
|---|---|---|---|
| 2,519,618 | 8/1950 | Wilson et al. | 261/78.2 |
| 2,523,126 | 9/1950 | Long | 261/78.2 |
| 2,713,476 | 7/1955 | Steichen | 261/78.2 |
| 2,797,904 | 7/1957 | Voorheis | 261/78.2 |
| 3,452,966 | 7/1969 | Smolski . | |
| 3,642,452 | 2/1972 | Roget et al. . | |
| 3,738,353 | 6/1973 | Santoleri . | |
| 4,287,138 | 9/1981 | Buckner . | |
| 4,345,915 | 8/1982 | Vakil et al. . | |
| 4,440,698 | 4/1984 | Bloomer . | |
| 4,792,097 | 12/1988 | Kremer, Jr. et al. | 261/78.2 |
| 4,880,447 | 11/1989 | Block . | |
| 5,102,583 | 4/1992 | Bannon . | |
| 5,130,102 | 7/1992 | Jones, Jr. . | |
| 5,376,311 | 12/1994 | DeGuzman . | |

FOREIGN PATENT DOCUMENTS

| | | | |
|---|---|---|---|
| 731001 | 4/1966 | Canada | 261/78.2 |
| 380804 | 12/1907 | France | 261/78.2 |
| 594115 | 9/1925 | France . | |
| 1090258 | 3/1955 | France | 261/78.2 |
| 1351575 | 12/1963 | France | 261/78.2 |
| 612005 | 4/1935 | Germany . | |
| 53-18928 | 8/1979 | Japan . | |
| 632386 | 11/1978 | U.S.S.R. . | |
| 713568 | 2/1980 | U.S.S.R. . | |
| 23351 | 10/1913 | United Kingdom . | |

*Primary Examiner*—Tim R. Miles
*Attorney, Agent, or Firm*—Kim Muller

[57] ABSTRACT

A device is provided for mixing two fluids, one a liquid, the other a gas, where apertures are provided in channel tubes to mix the fluids in the individual channels. The mixing device provides a two fluid admixture for passage to downstream processing, most preferably the tubeside of a shell and tube heat exchanger. The vessel is equipped with a gas inlet means located below a liquid inlet means with respect to the height of the vertical vessel. A distributor plate is situated substantially perpendicular to said channel or channels at a point in said vessel below said apertures for influx of the liquid into the gas phase. The apparatus provides uniform distribution of gas and liquid to all parallel channels.

8 Claims, 4 Drawing Sheets

DUAL PHASE DISTRIBUTION DEVICE

FIELD OF THE INVENTION

This invention is concerned with a uniform distribution and mixing apparatus to mix two distinct phases, one a liquid and the other a gas. These types of devices have historically been important in passing a dual phase mixtures to heat exchangers in many industries including the chemical and oil refining industries.

BACKGROUND OF THE INVENTION

A multistage reactor including a vertical column is disclosed in U.S. Pat. No. 3,642,452 (Tarbourich). A bundle of vertical tubes serve the ascent and descent of liquid. Pipes arranged in coaxial relation with respect to said tubes carry gas and a down tube is provided for better mixing of the phases.

Many prior art patents have discussed many means to mix two phases. In U.S. Pat. No. 3,452,966 (Smolski) liquid such as water is mixed with air via an open-ended vertical tube. The lower end of the tube is submerged in the liquid above a gas bubble generator. A helical baffle is provided to create a turbulence in the tube and assist in adsorption of the gas into the liquid.

In U.S. Pat. No. 3,738,353 (Santoleri) a series of sparger tubes are mounted below a heat exchanger within the confines of a baffle plate. Air bubbles are discharged upward which increases the transfer of heat from a waste-water stream. In U.S. Pat. No. 4,440,698 (Bloomer), a heat exchanger is provided whereby jets are created in the duct through which the gas flows which contacts the exchanger. Liquid is sprayed over the heat exchanger and high velocity jets of gas pick up liquid and carry it into the exchanger.

Finally, U.S. Pat. No. 5,376,311 (DeGuzman) discloses an apparatus for the aeration of liquids by passage of a gas through a porous diffuser thereby producing microsized bubbles dispersed in the liquid. A porous tubular member is provided in approximately the center of the apparatus.

BRIEF DESCRIPTION OF THE INVENTION

This invention is an apparatus for uniform distribution and mixing two phases together using a partitioned vessel having means for the inlet of gas and liquid to the vessel. Liquid enters the vessel, which is vertical in orientation, at a point in elevation higher than the gas inlet. The liquid and gas mix in the channels or tubes which are vertically orientated in the vessel, through an aperture in tubes for the ingress of liquid to the gas stream moving through the channels or tubes. It is preferred but not required that the vessel communicate with the tubeside of a shell and tube heat exchanger.

DETAILED DESCRIPTION OF THE INVENTION

In heat exchangers, the disproportionate flows and improper mix of vapors and liquid greatly affects performance. An improper mixture of gas and liquid in a heat exchanger has a negative influence on refinery operations. Tubes that become deficient in liquid tend to dry out and foul, which leads to a reduction in heat transfer rates. It also adds greatly to maintenance tasks.

In addition, conventional distributors can produce a relatively non-uniform distribution of liquid and thus are more sensitive to minor variations in heat exchanger orientation. Good liquid and gas distribution is particularly important where relatively small temperature differences exist between the hot and cold streams that exchange heat with each other in the heat exchanger.

This invention acts to insure uniform admixture of gas and liquid. This invention establishes a mixed stream that can be used in the tubeside of shell and tube heat exchangers. Instead of premixing liquid and gas in a single plenum below the exchanger and, then passing that admixture through a perforated plate, the apparatus described herein mixes the gas and liquid through apertures in vertically orientated channels or tubes.

The apparatus herein described is situated in a vertical orientation with respect to the horizon. The vessel is partitioned on the inside and has side walls, a bottom and a top. A gas inlet is provided at the bottom of the vessel. Gas may enter directly into the vessel, or as a preferred embodiment, the gas may accumulate in a plenum chamber having a solid plate defining the top of the plenum chamber interrupted only with apertures for the passage therefrom of the gas through one or more vertical tubes.

A liquid inlet means is also provided which is preferably located in elevated position with respect to the gas inlet and, if existent, the plenum chamber. The liquid inlet permits liquids, such as treated water or hydrocarbon liquids, to enter the vessel and be confined therein between the top of the plenum chamber (bottom) and the top part of the vessel. It is desirable that the liquid level be maintained at a level lower than the top of the vessel. The liquid level must however be maintained above the elevation of perforations or apertures in the channels wherein gas is being passed from the plenum chamber.

In a preferred embodiment of this invention, a liquid distribution plate may be situated above the top of the plenum chamber and below the level of the apertures in the tubes. The plate is equipped with multiple selectively sized and situated perforations or apertures to provide a uniform liquid level in the vessel at a point above the liquid distribution plate.

A hollow channel, or multiple channels, are provided for the passage of gas which mixes with the liquid. These channels are also referred to herein as tubes and will preferably have a circular cross section. However, any other cross-section can also be used such a square, rectangle or triangle. These tubes interconnect and communicate with the gas inlet or plenum chamber. Each tube contains one or more apertures to admix the gas with the liquid. As set forth above, the liquid level must be above the aperture height in order for the liquid to enter the tube to mix with the gas. The aperture or apertures may have any cross-section although circular apertures are preferred for manufacturing purposes. While not a preferred embodiment herein, the apertures on the tubes may be arranged at different heights and it is possible to have multiple apertures at different heights on the same tube.

The top of the vessel is constructed so that the mixture of gas and liquid pass from the vessel to use downstream in a different vessel or environment. The structure of FIGS. 4–6 discussed herein show preferred embodiments concerning passage downstream to other uses but this invention should not be limited to those specific preferred embodiments. And, as shown in FIG. 2, the channel tubes may actually penetrate the bottom of a shell and tube heat exchanger with the gas-liquid mixture in the tubes being used to indirectly cool or heat a liquid or a gas in an exchanger. In this embodiment, the used gas-liquid admixture exits the heat exchanger through an outlet means in the top of the exchanger.

DETAILED DESCRIPTION OF THE DRAWINGS

Figure 1:
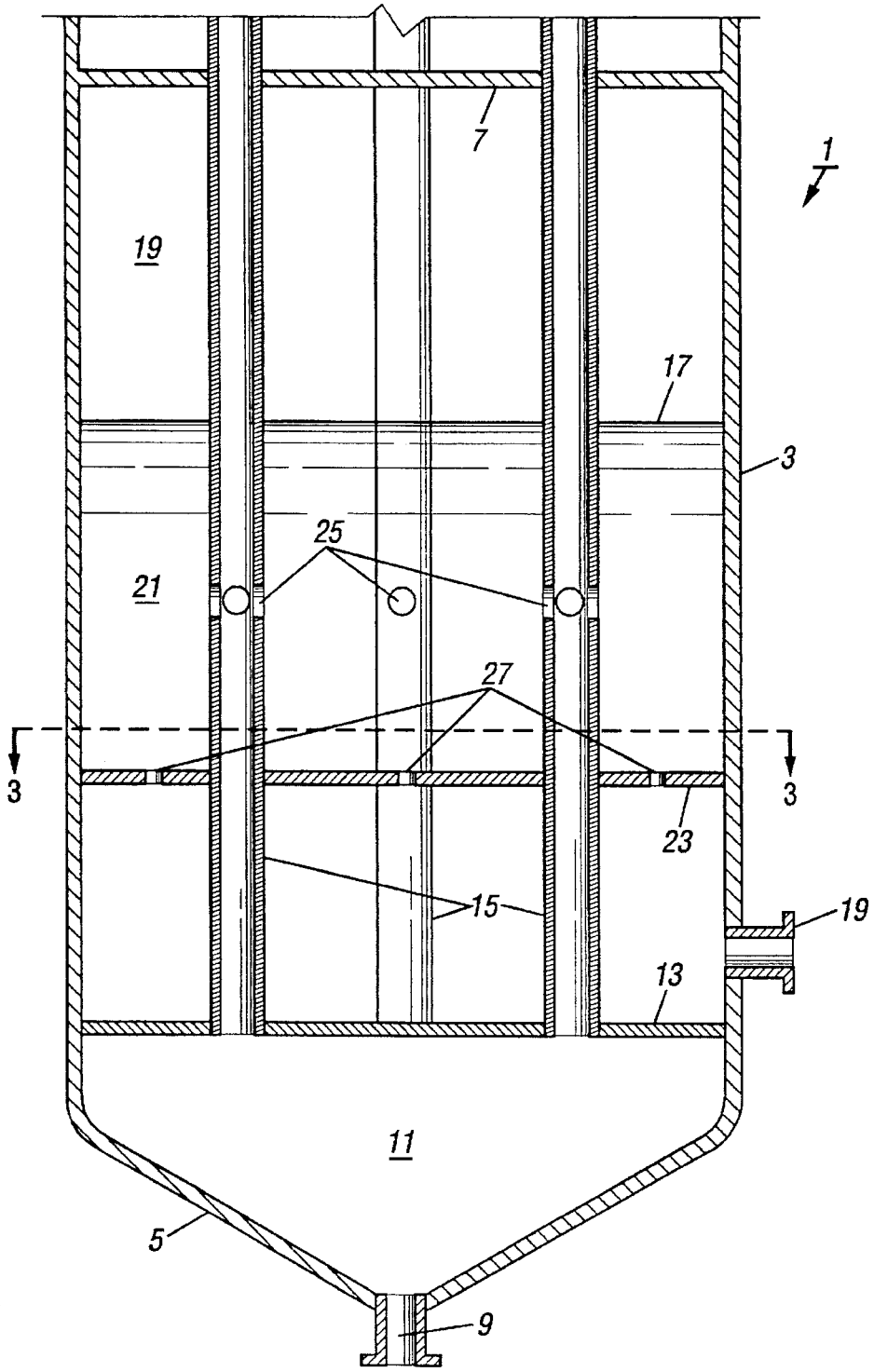
FIG. 1 is a side view of the mixing apparatus of this invention.

In FIG. 1 a vertical vessel 1 is shown with the necessary elements that comprise this invention although other additional elements that are not integral to the function of the mixing of the two phases are not shown. The vertical vessel is partitioned to accomplish the mixing of the two phases. The vessel comprises side walls 3, bottom 5 and top 7. The bottom of the vessel 5 communicates with a gas inlet 9 for the flow of gas into the vessel. In a preferred embodiment, gas inlet 9 communicates with the interior of the vessel through a plenum chamber 11 having a top plate 13 which extends from each side wall 3. The gas chamber is designed to provide uniform flow of gas to all tubes 15. Top plate 13 is imperforate with the exception of at least one, and preferably more, tubes 15 openly communicate with the plenum chamber and the upper portion of the vessel. Thus, gas rises from the inlet means 9, to the plenum chamber 11 and then through tubes 15 for eventual admixture with a liquid phase.

Tubes 15 may be any length as long as they extend to a point above the level of liquid 17 which may vary in different vessels which are used for mixing different phases. As a corollary, an open space 19 of varying height is provided intermediate the liquid level 17 and the vessel top 7.

A liquid inlet is provided in the vessel for the flow of liquid into the vessel which is to be mixed with the gas in tubes 15. The liquid is segregated from plenum chamber 11 and is situated in the vessel at an elevated height with respect to either plenum chamber 11 or gas inlet 9 via imperforate plate 13 and tubes 15 which seal the apertures in the otherwise solid plate 13. Liquid passes into vessel 1 to form a liquid reservoir 21 having a level shown at 17. In a preferred embodiment, the liquid is evenly distributed to the vessel interior via a liquid distribution plate 23 having select predetermined perforations therein for the controlled passage of liquid to liquid reservoir 21. Distribution plate 23 must be positioned above (or higher than) liquid inlet 19.

Gas passes upwardly through tubes 15 and mixes with liquid entering via apertures 25 situated in tubes 15. Apertures 25 in tubes 15 are located in the tubes at a height above liquid distribution plate 23 and below the level of liquid 17 in vessel 1. The apertures 25 may comprise any number of openings in the form of a large number of pin hole openings to one opening specifically sized to enhance the mixing of the two phases. Liquid passes from the liquid reservoir to the interior of tubes 15 via apertures 25. In this manner, the two phases are admixed immediately upstream of use in a vessel, such as a heat exchanger in another vessel surmounted to vessel 1.

Figure 2:
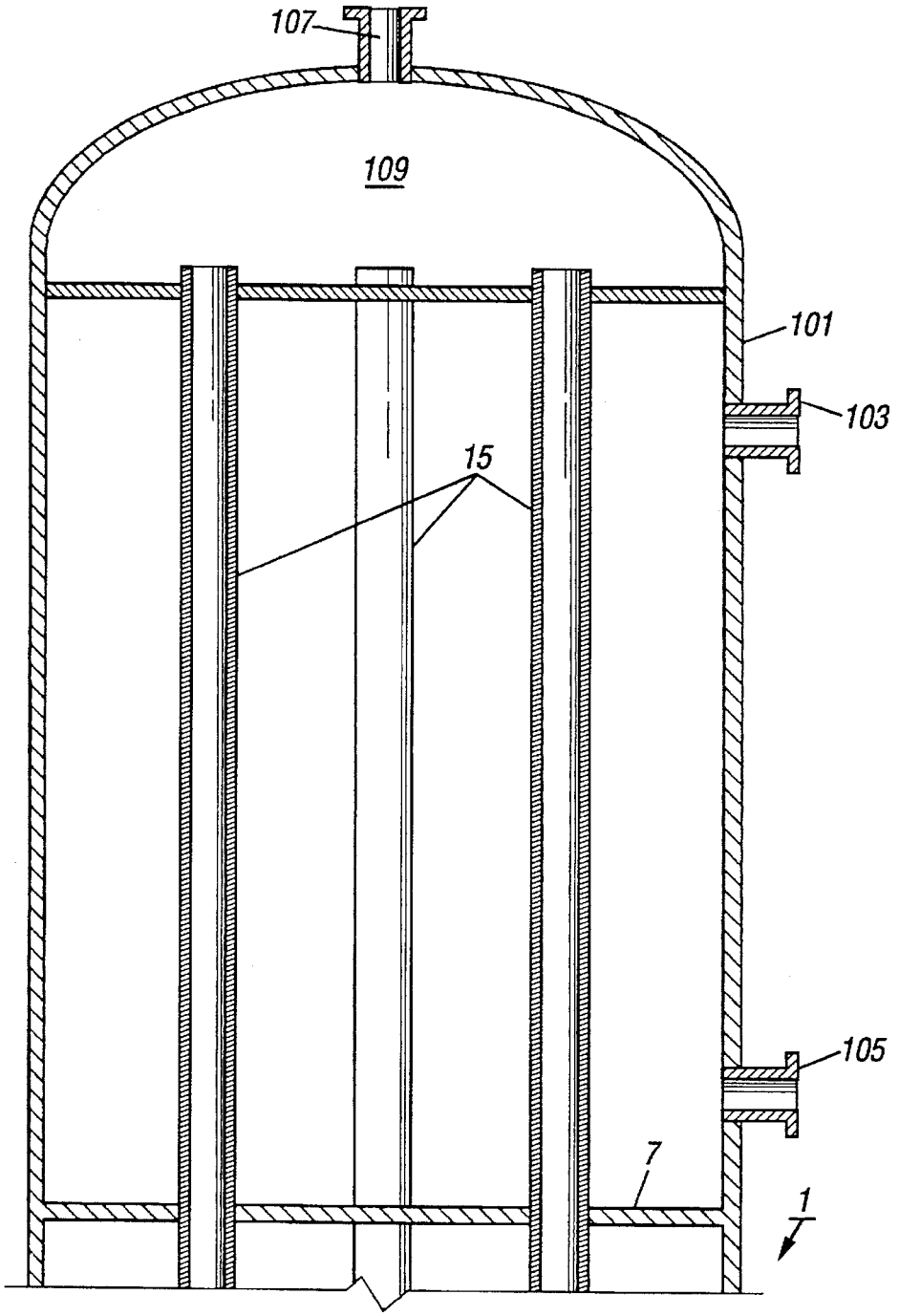
FIG. 2 is a side view of a shell and tube heat exchanger receiving the mixed phase from the apparatus of FIG. 1.

FIG. 2 shows a shell and tube heat exchanger 101 which is situated immediately above mixing vessel 1. The top 7 of vessel 1 forms the bottom of heat exchanger 101. Top 7 is imperforate with the exception of openings for passage of tubes 15 into the exchanger. The connection of the tubes with top 7 are sealed on the top and bottom of top 7 via any conventional means such as welding. Exchanger 101 is equipped with inlet means 103 and outlet means 105 for the passage of shellside fluid into and out of the exchanger. The fluid entering the exchanger indirectly contacts the mixed phases from vessel 1 via tubes 15 and thereby either cools or heats the fluid to the desired level of temperature. The mixed phase of fluids passing through tubes 15 in vessel 101 exits the exchanger through outlet means 107 which communicates with a collection space 109 which does not communicate with the shellside fluid that is being cooled or heated in exchanger 101.

Figure 3:
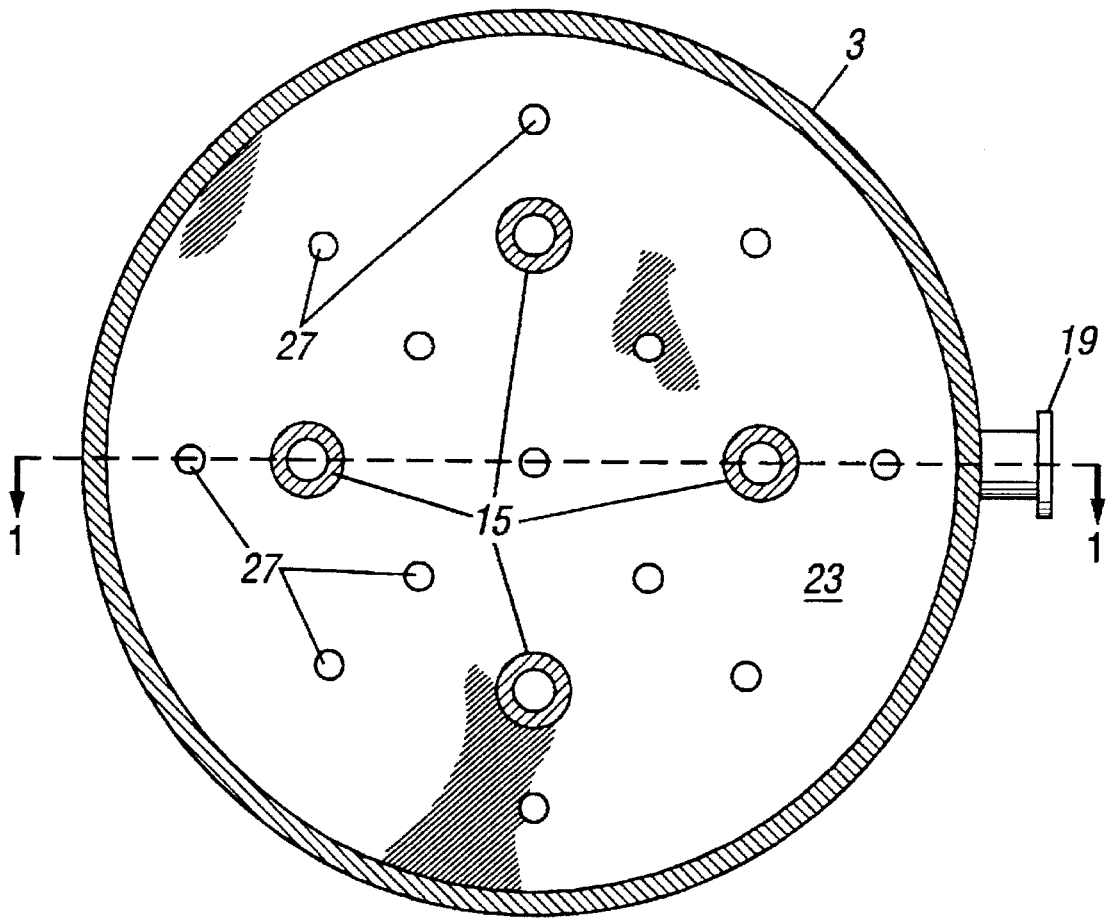
FIG. 3 is a cross section of the apparatus of FIG. 1.

FIG. 3 shows a cross section of vessel 1 wherein tubes 15 rise above distribution plate 23 and liquid is supplied to the liquid reservoir 21 via perforations 27 in plate 23.

Figure 4:
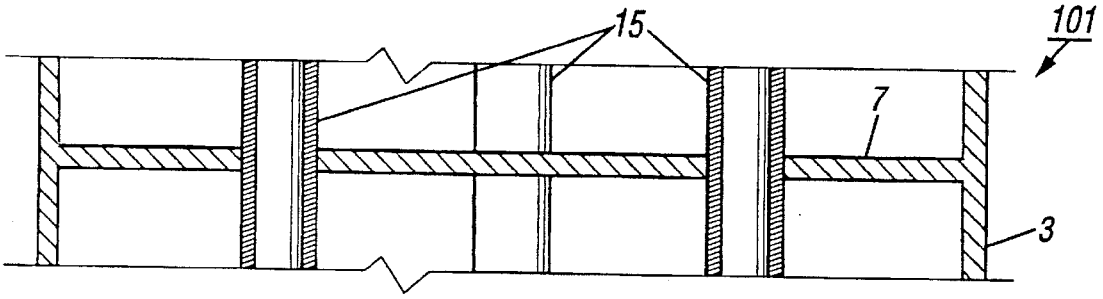
FIG. 4 is a side view of the discharge of the mixed phase from the vessel.

FIG. 4 is a side view of the upper portion of vessel 1 and the lower portion of vessel 101. This configuration is a preferred means of passing the mixed phases to a surmounted heat exchanger. Tubes 15 penetrate top plate 7 thereby passing the mixed phase from vessel 1 to vessel 101 for use therein however, the area above and below plate 7 do not communicate with one another.

Figure 5:
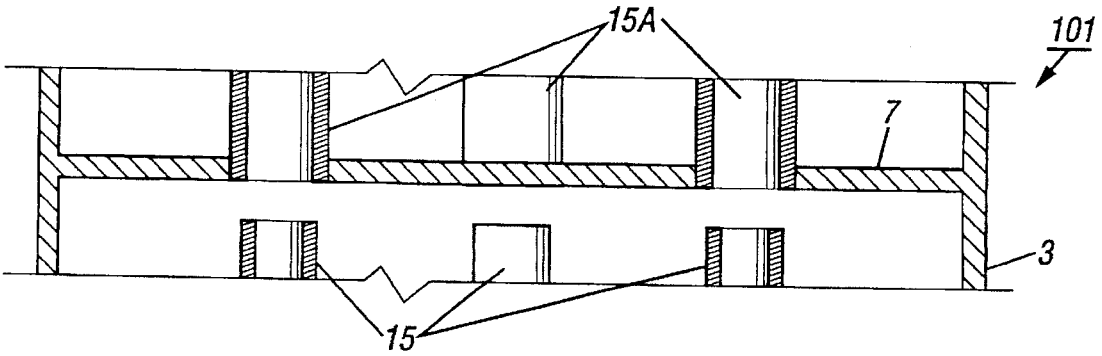
FIGS. 5 and 6 are side views of modifications containing discharge devices not shown in FIG. 4.
Figure 6:
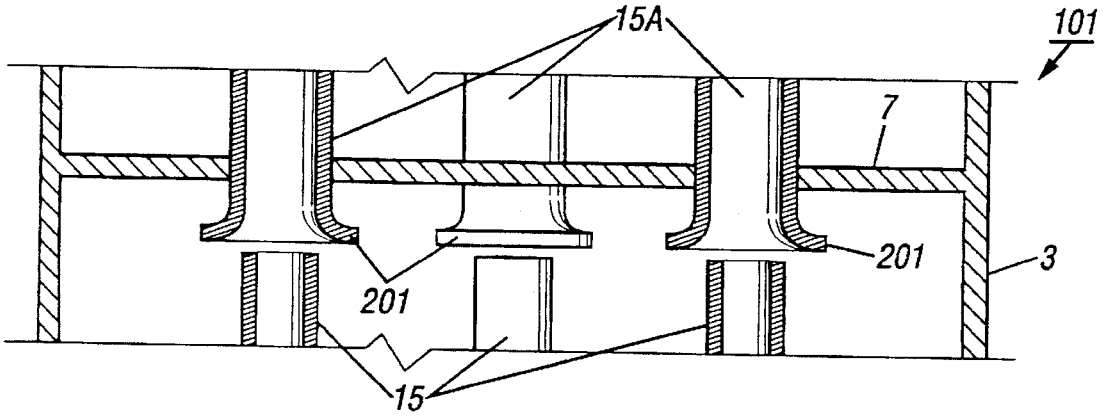

FIG. 5 shows via a side view, tubes 15 ending or terminating immediately below top plate 7. A second set of tubes 15A is positioned above and juxtaposed to the terminus of tube 15 for passage of a gas/liquid admixture from tube 15 directly into tubes 15A, located in vessel 101. FIG. 6, via a side view, shows another configuration whereby tubes 15A from vessel 101 penetrate the top 7 of vessel 101. The bottom of tubes 15A are equipped with with flared inlet, 201. These flares may extend from the ends of tube 15A or from plate 7. If a line is drawn of the angle that flare 201 makes with the plate, that angle is less than 90°.

What we claim as our invention is:

1. An apparatus for distribution and mixing two phases, one a liquid and the other a gas, which apparatus comprises:

a) a vertically situated partitioned vessel having side walls, bottom and top;

b) a gas inlet means for passage of a gas to a channel or multiple group of channels as defined below;

c) a liquid inlet means for passage of a liquid to said vessel, wherein said liquid inlet means communicates with said vessel at a point elevated with respect to said gas inlet;

d) a channel or multiple channels defined by elongated hollow tubes communicating with said gas inlet and the top of said vessel for passage of gas therethrough;

e) one or more apertures situated at a height in said channel or channels such that liquid enters said channel or channels to admix with said gas passing therethrough;

f) gas and liquid outlet means situated in the top of said partitioned vessel to provide for passage of mixed fluids from said vessel to another vessel wherein said mixed fluid is used; and g) a liquid distribution plate situated perpendicular to said vessel side walls at a location above said liquid inlet and possessing multiple apertures for passage of liquid from below said plate to above said plate.

2. The apparatus of claim 1 wherein said gas inlet means comprises a conduit which communicates with a reservoir of gas wherein said reservoir communicates directly with said channel or channels.

3. The apparatus of claim 1 wherein said distributor plate is situated in said vessel below said aperture or apertures in said channel or channels.

4. The apparatus of claim 1 wherein said liquid inlet means passes liquid into said vessel to form a liquid level in said vessel at a point above the apertures or apertures in said channel or channels.

5. The apparatus of claim 1 wherein the outlet means from said vessel comprises the penetration of said channel or channels through said top of vessel.

6. The apparatus of claim 1 wherein the outlet means from said vessel comprises apertures in said top of said vessel positioned juxtaposed to the terminus of said channels or channel.

7. The apparatus of claim 6 wherein the apertures in said top of said vessel are equipped with mixed phase accumulation means for maximizing the quantity of mixed phase captured in said outlet means.

8. The apparatus of claim 7 wherein the mixed phase accumulation means comprises curved elongated members such that the angle formed by joining of the curved elongated member and the outlet aperture is less than 90°.

* * * * *